US005189895A

United States Patent [19]

Schwab et al.

[11] Patent Number: 5,189,895

[45] Date of Patent: Mar. 2, 1993

[54] LOCKING MECHANISM FOR MOTOR VEHICLES

[75] Inventors: Dittmar Schwab, Rodgau; Dieter Knauer, Offenbach am Main, both of Fed. Rep. of Germany

[73] Assignee: Yoms Aktiengesellschaft Industrieprodukte, Obertshausen, Fed. Rep. of Germany

[21] Appl. No.: 608,305

[22] Filed: Nov. 2, 1990

[30] Foreign Application Priority Data

Nov. 11, 1989 [DE] Fed. Rep. of Germany ..... 3937611
Jun. 22, 1990 [DE] Fed. Rep. of Germany ..... 4019943

[51] Int. Cl.[5] ..... E05B 25/08

[52] U.S. Cl. ..... 70/366; 70/389; 70/395

[58] Field of Search ..... 70/252, 349, 365, 366, 70/377, 387, 389, 491, 492, 395, 401, 405, 407, 409

[56] References Cited

U.S. PATENT DOCUMENTS

| | | | |
|---|---|---|---|
| 834,918 | 11/1906 | Lindgren | 70/365 |
| 1,193,412 | 8/1916 | Nelson | 70/365 X |
| 1,317,828 | 10/1919 | Sellstone | 70/365 X |
| 1,594,297 | 7/1926 | Muzzio | 70/365 |
| 3,404,548 | 10/1968 | Keefer | 70/366 X |
| 3,509,748 | 5/1970 | Trainor | 70/389 X |
| 4,044,578 | 8/1977 | Guiraud | 70/366 |
| 4,069,695 | 1/1978 | Frank | 70/491 |
| 4,941,336 | 7/1990 | Steckler | 70/366 X |
| 4,953,420 | 9/1990 | Krubsack et al. | 70/366 |
| 5,029,459 | 7/1991 | Almblad | 70/395 |

FOREIGN PATENT DOCUMENTS

| | | | |
|---|---|---|---|
| 2420272 | 12/1974 | Fed. Rep. of Germany | 70/365 |
| 2731138 | 1/1979 | Fed. Rep. of Germany | 70/365 |
| 8003916 | 3/1982 | Fed. Rep. of Germany . | |
| 8505753 | 6/1985 | Fed. Rep. of Germany . | |
| 3503660 | 8/1986 | Fed. Rep. of Germany | 70/365 |
| 43046 | 9/1970 | Finland | 70/389 |
| 605693 | 6/1960 | Italy | 70/405 |
| 128078 | 5/1990 | Japan | 70/395 |

*Primary Examiner*—Renee S. Luebke
*Assistant Examiner*—Suzanne L. Dino
*Attorney, Agent, or Firm*—W. G. Fasse

[57] ABSTRACT

A cylinder lock, especially suitable for motor vehicle doors, has a locking cylinder and a key, whereby the locking cylinder includes at least one cylinder housing with at least one blocking channel and one cylinder core with tumblers, each of which is movable about its own axis. At least one protruding cam or a recess is provided on the key or on the tumblers for transmitting the linear key motion in the key channel into a motion of each tumbler about its own axis.

23 Claims, 10 Drawing Sheets

LOCKING MECHANISM FOR MOTOR VEHICLES

FIELD OF THE INVENTION

The invention relates to a locking device, especially suitable for motor vehicles with a locking cylinder and a key, whereby the locking cylinder comprises at least one cylinder housing with at least one blocking channel and a cylinder core with tumblers.

BACKGROUND INFORMATION

Locking devices of the mentioned type are known in a great variety of constructions and are installed in doors, tailgates, and steering columns of motor vehicles. Furthermore, these locking constructions are also used in many other cases.

SUMMARY OF THE INVENTION

It is the object of the invention to construct a locking device of the generally mentioned type in such a manner that new and previously unknown locking possibilities are achieved.

In order to achieve this object, the invention provides that the tumblers are each movable about an axis, and that at least one protruding cam or recess is provided on the key or on the tumbler for transmitting the linear key motion into a motion of the tumblers about their respective axis.

Thus, the tumblers are not linearly movable relative to the key channel, but instead they are tiltable and in the blocking position they reach with at least one nose located on their circumference into the blocking channel or they are positioned with their nose outside of the blocking channel so that the cylinder core is freely rotatable.

The actuation of the tumblers by means of the key is achieved by recesses and ratchet teeth or actuating control teeth which allow the construction of novel keys and thereby offer a large number of possible variations.

Further characteristic details of the invention are evident from the description and the claims in conjunction with the drawings.

BRIEF DESCRIPTION OF THE DRAWINGS

The invention will be described in greater detail in the following, in conjunction with example embodiments shown in the drawings, wherein.

DETAILED DESCRIPTION OF PREFERRED EXAMPLE EMBODIMENTS AND OF THE BEST MODE OF THE PRESENT INVENTION

Figure 1:
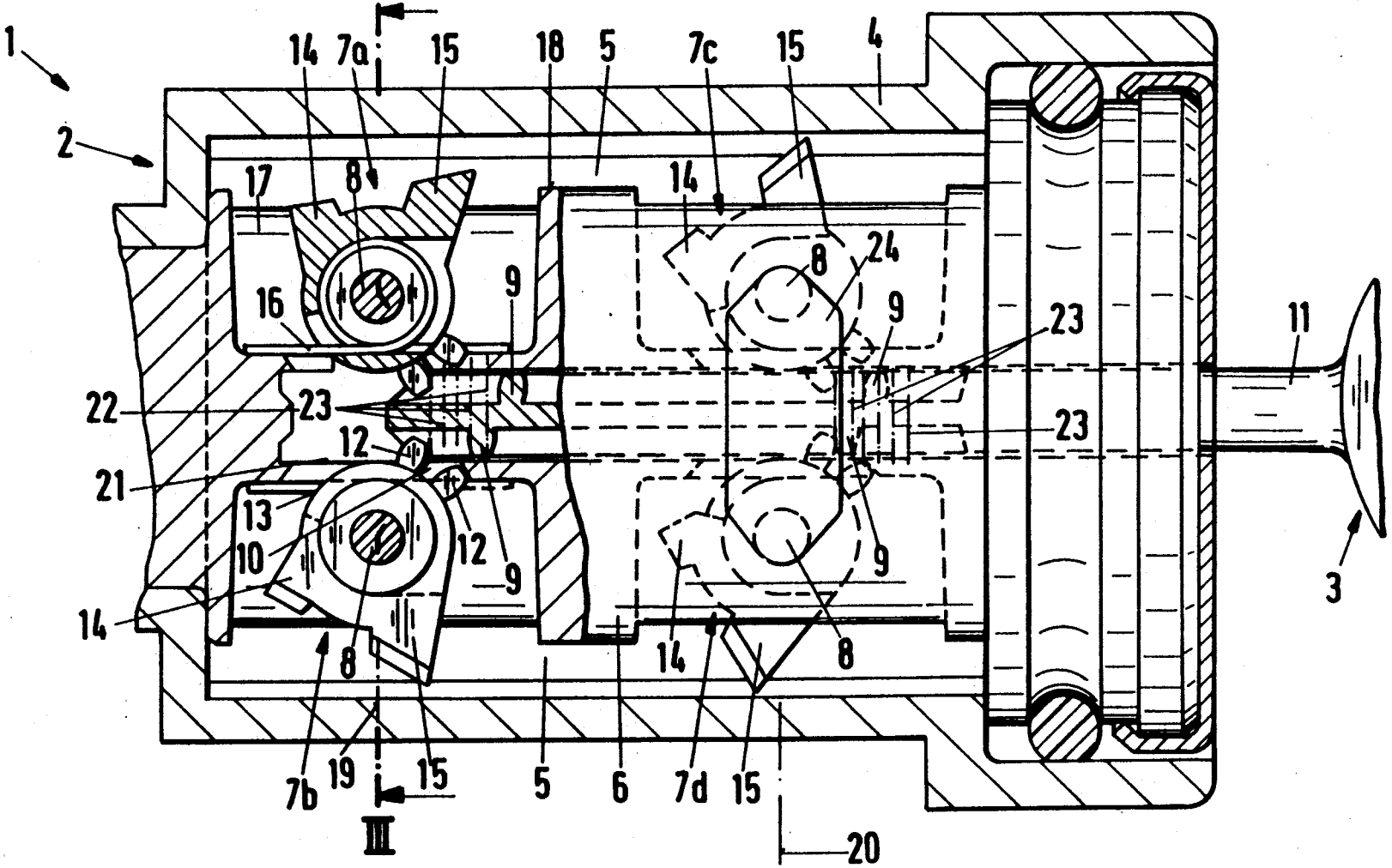
FIG. 1 shows a lengthwise section through the locking device in the locked position, on an enlarged scale.
Figure 2:
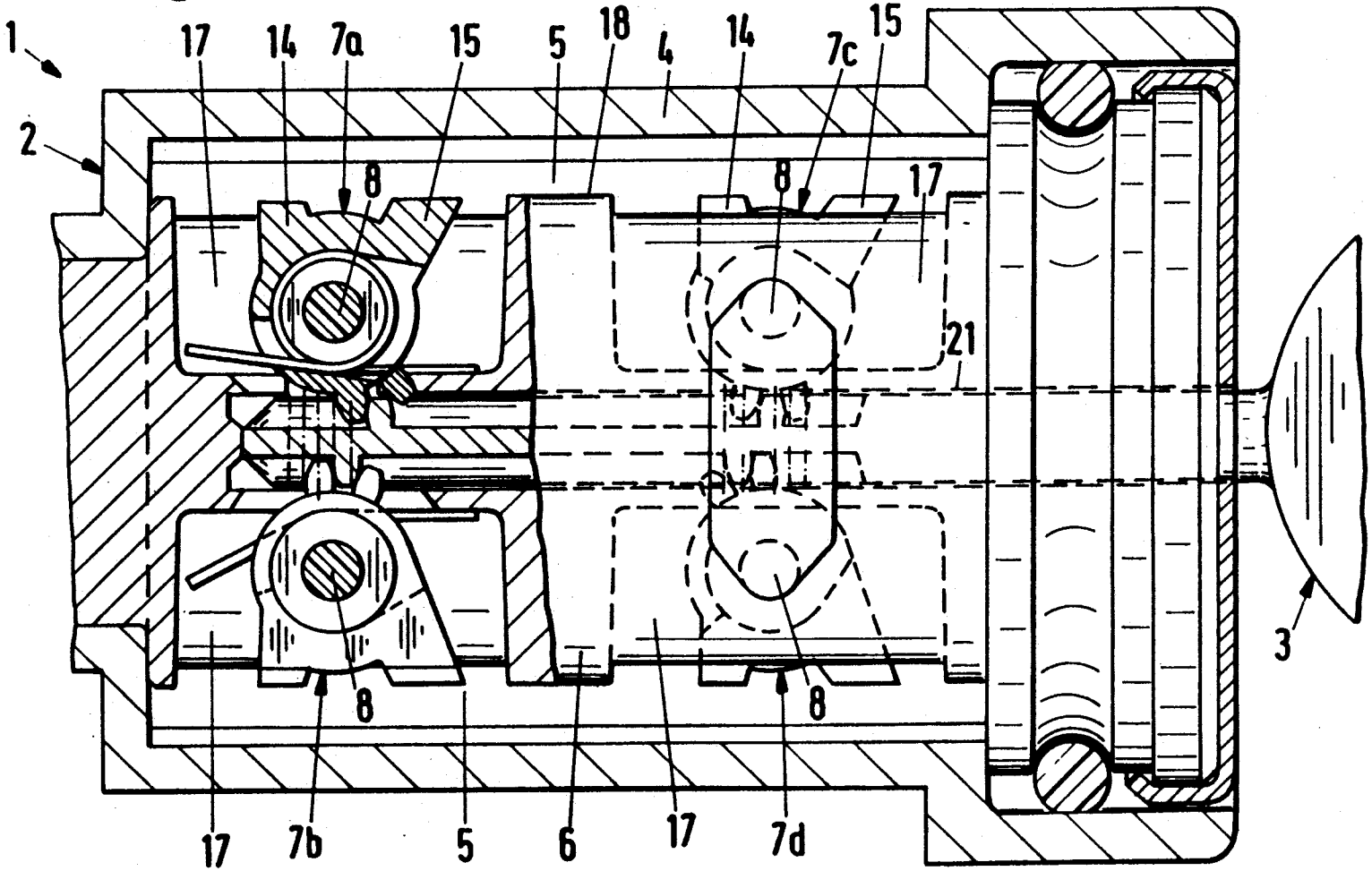
FIG. 2 shows a lengthwise section on an enlarged scale as in FIG. 1, but in the open position.

A locking device 1 according to FIG. 1, which is especially suitable for use in motor vehicle doors, comprises a locking cylinder 2 and a key 3. A cylinder housing 4 with blocking channels 5 and a cylinder core 6 with tumblers 7*a*, 7*b*, 7*c*, and 7*d* are part of the locking cylinder 2.

Each of the tumblers 7*a* to 7*d* is rotatably supported on its own tumbler axis 8 in the cylinder core 6. Further, at least one protruding cam 9 or a recess 10 is provided on the key 3 or on each of the tumblers 7*a* to 7*d* for transmitting the linear key motion into a rotating motion of the tumblers 7*a* to 7*d* each about its respective axis 8.

Figure 3:
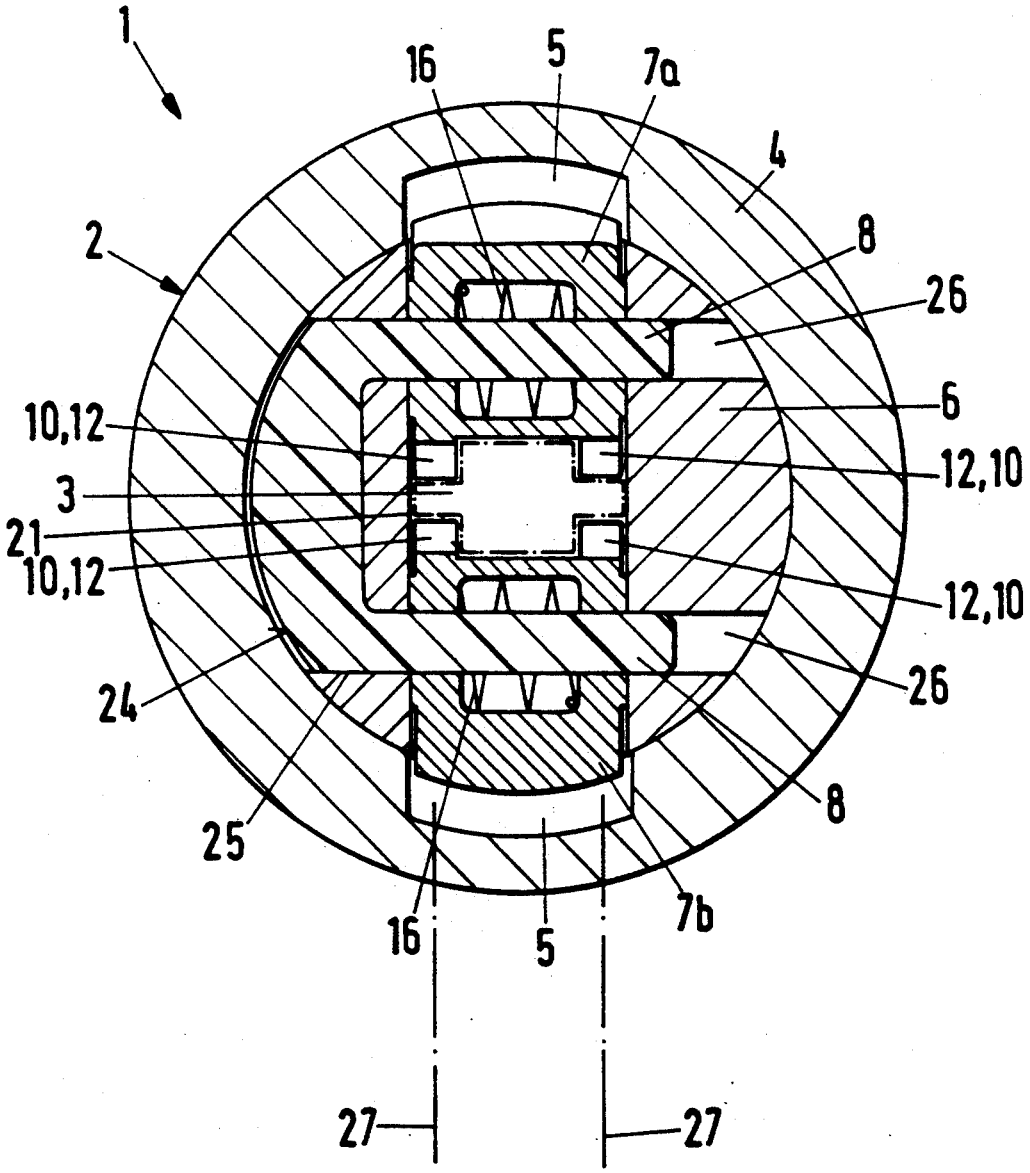
FIG. 3 shows a section along the line III—III in FIG. 1.
Figure 4:
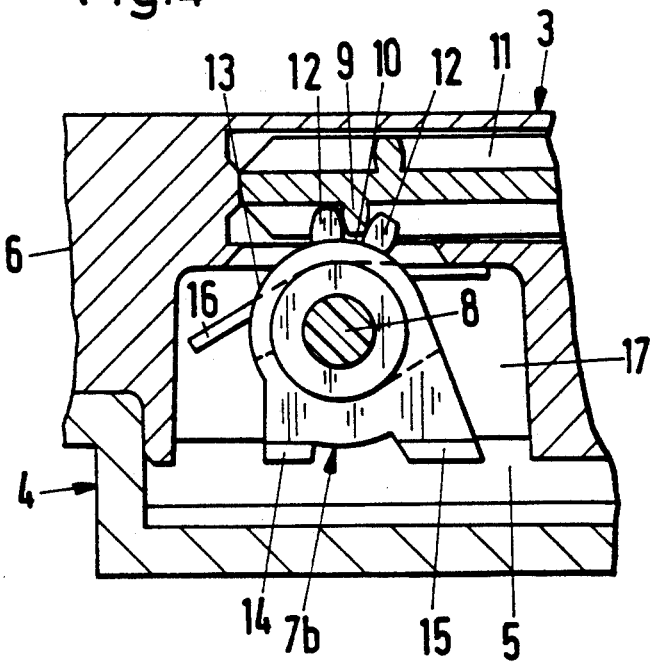
FIG. 4 shows a detail of the tumblers on a still larger scale.

In the example embodiments shown in FIGS. 1 to 4, the protruding cam 9 is located on the key 3 or on its key shaft 11, while a recess 10 is arranged on each of the tumblers 7*a* to 7*d*. In order to form the recesses 10 two ratchet cog teeth 12 respectively are provided on the circumference 13 of each tumbler 7*a* to 7*d* which is especially evident from the view of FIG. 4 shown on a still larger scale.

As the blocking element the tumblers 7*a* to 7*d* further comprise at least one nose 14 or 15 on the tumbler's circumference 13, whereby the nose 14 or 15 is tiltable into the blocking channel 5, (FIG. 4). These noses 14, 15 are arranged diametrically opposite the recess 10 or the ratchet cog teeth 12.

Due to the overall selected component dimensions, the tumblers 7*a* to 7*d* are tiltable, but not freely rotatable about the axes 8. Furthermore, the tumblers 7*a* to 7*d* are biased by a torque spring 16, FIG. 4, which respectively presses the tumblers into the blocking position, so that the tumblers must be tilted by means of the key 3 respectively against a spring force out of the blocking position into the release position.

The cylinder core 6 comprises radially outwardly open pockets 17 which receive the tumblers 7*a* to 7*d*. The tumblers 7*a* to 7*d* are tiltably supported in the pockets 17 and according to FIG. 1 only reach with their noses 15 out of the pockets 17 in the blocking position. In the release position according to FIG. 2, the tumblers 7*a* to 7*d* rest with their noses 14 and 15 in the pockets 17, whereby they are in a position forming a flush surface with the circumference 18 of the cylinder core 6.

The axes 8 of the tumblers 7*a* and 7*b*, as well as their corresponding pockets 17 are arranged in a radial plane 19 of the cylinder core 6 while the axes 8 of the two other tumblers 7*c* and 7*d* are located in a second radial plane 20, FIG. 1. Thus, tumblers 7*a* to 7*d* and pockets 17 are provided in more than one plane 19, 20, whereby preferably four tumblers 7*a* to 7*d* lie in a total of two radial planes 19, 20.

The key 3 comprises for each tumbler 7*a* to 7*d* a single protruding cam or tooth 9 in the form of an actuating control tooth 9. During the linear motion of the key shaft 11 in the key channel 21 this actuating control tooth 9 engages the ratchet cog teeth 12 of the tumblers 7a to 7d, or rather it runs into the recess located between the two ratched teeth 12 and during the further linear motion up to a stop 22, it pushes the tumblers 7a to 7d into their release position according to FIG. 2. The situation just before the entry of the actuating control teeth 9 of the key 3 into the recesses 10 of the tumblers 7a to 7d is shown in FIG. 1, whereby further taking the permutation possibilities or multiple variations into account, the four actuating control teeth 9 can be arranged in different key planes 23. The recesses 10 or the ratchet teeth 12 are basically always provided at the same location on the circumference of the tumblers 7a to 7d. However, the noses 14 or 15 of different tumblers 7a to 7d are arranged offset on the tumblers 7a to 7d, relative to each other and relative to the ratchet teeth 12 due to the permutation possibilities.

In the example embodiment shown, each tumbler 7a to 7d comprises two noses 14 and 15, whereby the second nose will still be blocking when the first nose is located in a release position in case a wrong key is used, or for example, when the tumblers are tilted by means of a toothed rack.

For production technological reasons it is advantageous if the axes 8 for the tumblers 7a to 7d are located on inserts 24 which may be inserted in corresponding recesses 25 of the cylinder core 6. As shown in FIG. 3, the insert 24 is at least partially contour flush with the cylinder core 6, whereby furthermore, the free ends of the axes 8 are located in cylindrical through-holes 26 of the cylinder core 6 according to the example embodiment.

FIG. 3 further shows that the tumblers 7a to 7d may comprise recesses 10 or ratchet teeth 12 in more than one plane 27, for a nonreversible key. Preferably, recesses 10 and ratchet teeth 12 are located in two planes 27, FIG. 3, and correspondingly, the key 3 for such tumblers also has actuating control teeth 9 arranged in more than one plane 27. Preferably, in the case of a nonreversible key two recesses 10 and four ratchet teeth 12 are located on each tumbler 7a to 7d and correspondingly, two actuating control teeth 9 are provided on the key 3 for each tumbler 7a to 7d. However, this is only true for nonreversible keys. In the case of reversible keys, each tumbler comprises only one single recess 10, and correspondingly, two ratchet teeth 12.

Figure 5:
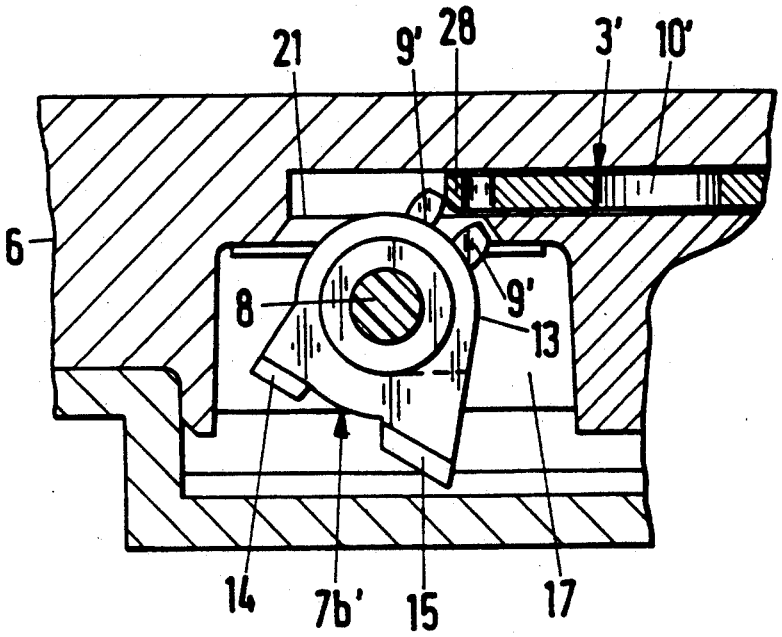
FIG. 5 shows a broken away portion of a detail of a modified embodiment with a cylinder core tumbler and key end.

FIG. 5 shows a modified embodiment or rather only a portion thereof, showing only a broken-off portion of the cylinder core 6 with the tumbler channel 21 and the pocket 17 in which a tumbler 7b' is tiltably supported on an axis 8. Similarly, FIG. 5 shows only the end of key 3' next to the key tip 28.

The embodiment according to FIG. 5 differs from the locking arrangement 1 according to FIGS. 1 to 4, in that the tumbler 7b' comprises at least one cam 9' protruding beyond the tumbler circumference 13 whereby the cam 9' is in the form of actuating control teeth 9', and the key 3' comprises a recess 10' corresponding to the cam 9' of the tumbler 7b'. The protruding cam 9' thus is not located on the key 3', but instead it is on the tumbler 7b'. Correspondingly the recess 10' is no longer arranged on the tumbler 7b', but instead it is on the key 3'. The recess 10' comprises a relatively large free length, which is necessary, because, according to the example embodiment, a second cam 9' must also be received in this recess 10 when the tumbler 7b' is located in the release position.

Finally, the embodiment according to FIG. 5 shows that many variations are possible within the scope of the invention and that therefore, the invention is not limited to the concretely shown and described features.

Figure 6:
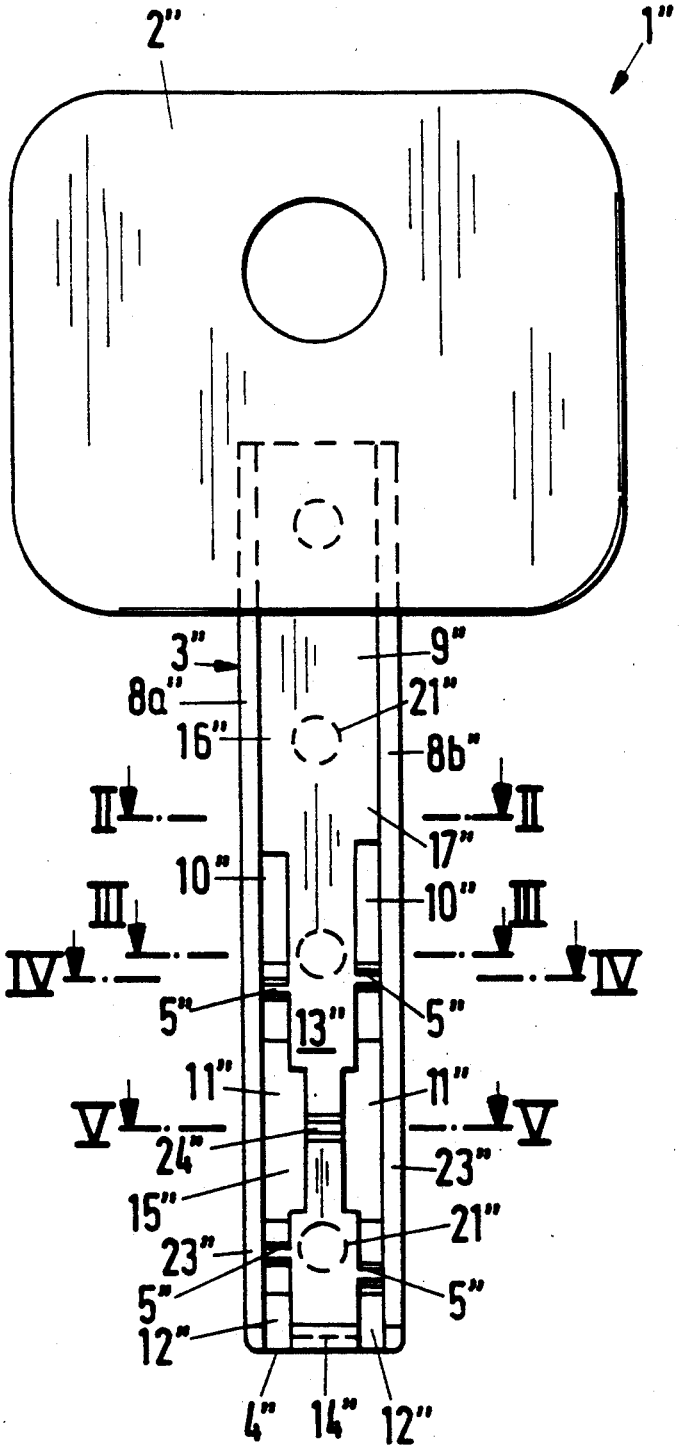
FIG. 6 shows a view of the key on an enlarged scale.
Figure 7:
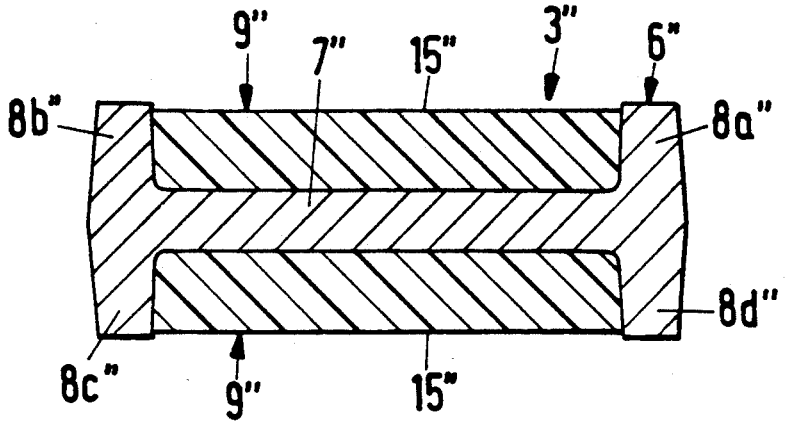
FIG. 7 shows a section along the line II—II in FIG. 6 on an enlarged scale.

According to FIG. 6, a key 1" comprises a key grip 2" and a key shaft 3" which includes a key tip 4" and control elements 5" for activating or controlling tumblers in a cylinder lock. The key shaft 3" comprises a carrier 6" according to FIG. 11, having a double T-shaped or rather I cross-section which consists of a web 7" and four shanks 8a", 8b", 8c", and 8d". Further, according to FIGS. 6 to 10, the key shaft 3" is formed of a synthetic plastic coating 9" which is preferably arranged on both sides of the web 7" and between the shanks 8a" and 8b", or 8c" and 8d", FIG. 7.

The double I-cross-section carrier 6" is a metallic core of sufficient strength which is at least partially covered by the synthetic plastic coating 9" forming the control elements 5". The plastic coating extends on the grip side end of the key shaft 3" from a shank 8a" to the other shank 8b" and then transitions into a middle web 13" due to lateral cut-outs or recesses 10", 11", and 12", whereby the free end 14" of the middle web 13" extends around the key tip 4" and then continues on the other side of the key shaft. For example, for a reversible key, the plastic coating continues on the other side of the key shaft, in a corresponding middle web with lateral cut-outs or recesses.

Figure 8:
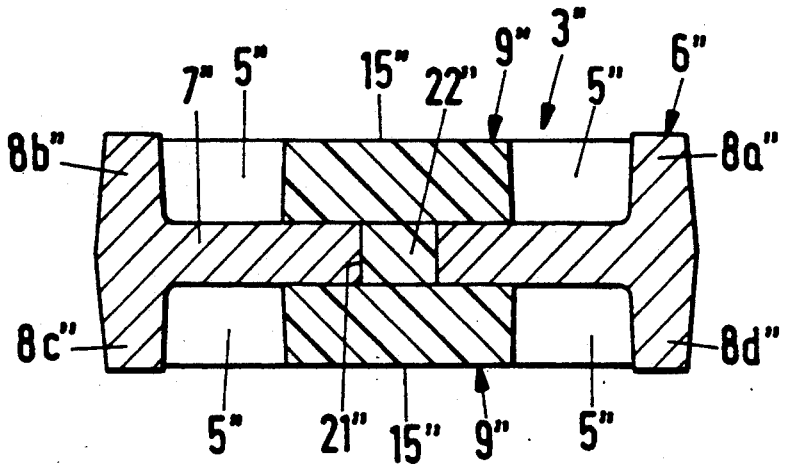
FIG. 8 shows a section along the line III—III in FIG. 6 on an enlarged scale.
Figure 9:
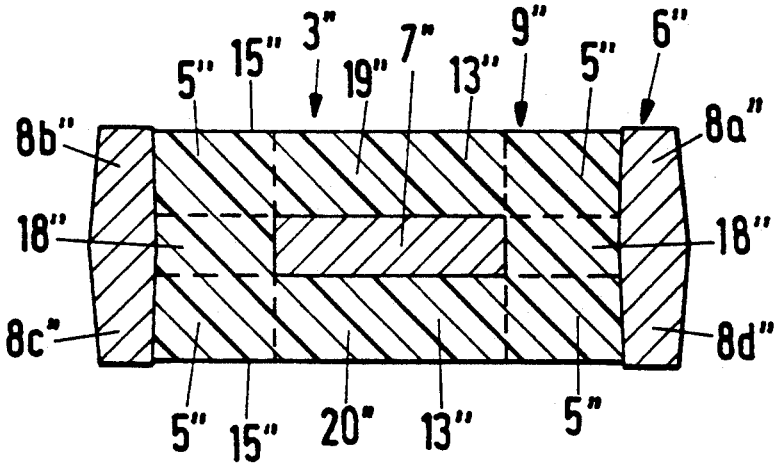
FIG. 9 shows a section along the line IV—IV in FIG. 6 on an enlarged scale.
Figure 10:
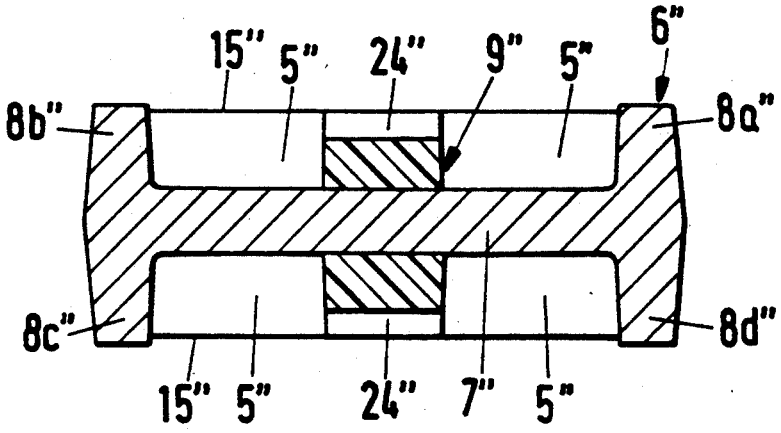
FIG. 10 shows a section along the line V—V in FIG. 6 on an enlarged scale.

The control elements 5" of the example embodiment shown in FIGS. 6 to 10, are protruberances made of synthetic plastic material, and thereby are control teeth standing perpendicularly to the flat surface 15" of the key shaft 3". Further, the control teeth are preferably unitarily connected with the middle web 13" or with the plastic coating 9" to form one piece. As shown in FIGS. 8 and 10, the control teeth 5" are also preferably arranged recessed into the flat surface 15" of the key shaft 3".

In a reversible key according to the example embodiment, each flat side surface 15" of the key shaft 3' may comprise two rows 16" and 17" of control teeth 5", whereby these are then arranged directly next to the shanks 8a" to 8d" of the key shaft 3" or respectively between the middle web 13" and the shanks 8a" to 8d".

Figure 11:
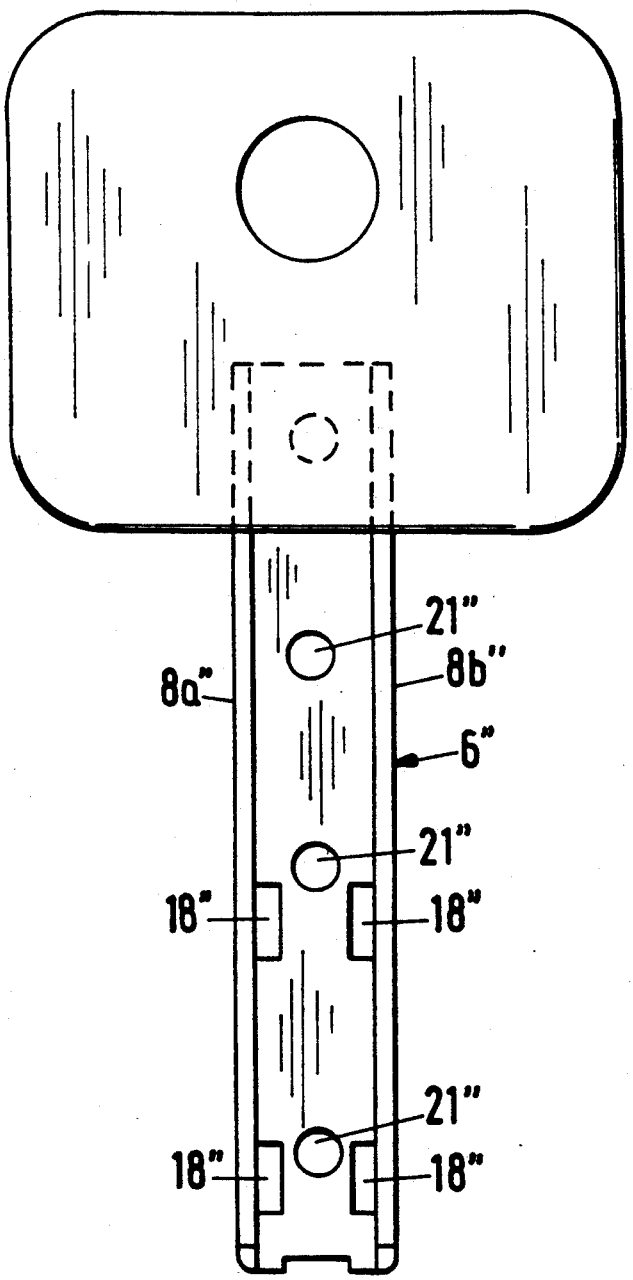
FIG. 11 shows a view as in FIG. 6, of the metallic key shaft with a grip.

In order to achieve a secure fixing of the control teeth 5" onto the key shaft 3", the I-cross-section carrier 6" comprises through-holes 18" in its web 7" in the area of the control teeth 5" as shown in FIG. 9 and FIG. 11. The plastic coating 9" completely fills the through-holes 18", FIG. 9, and thereby also interconnects the plastic coating parts 19" and 20" located on both sides of the web 7", FIG. 9. The control teeth 5" protrude above the plastic located in the through-holes 18" and are unitarily interconnected with the middle web 13" or the middle webs 13" on both sides of the key 1" to form one piece. The through-holes 18" are elongated holes and extend in the lengthwise direction of the key shaft. The length of the through-holes 18" is considerably longer than the width of the control teeth 5" in the direction of the key shaft 3". The control teeth 5" can therefore be arranged at various locations in the area of the through-holes 18". This is also actually desirable due to the required permutation possibilities.

In the example embodiment shown in the Figures the key shaft 3" comprises only two control teeth 5" in each tooth row 16" or 17". The control teeth 5 are arranged with a large spacing from one another and they can vary position-wise corresponding to the size of the through-holes 18", FIG. 11, or they can be arranged more or less distant from one another. However, their position is respectively always defined by the position of the through-holes 18".

Further, through-holes 21" are provided in the web 7" of the I-cross-section carrier 6", which similarly serve to fix or unitarily interconnect the two-sided plastic coating parts 19", 20". The through-holes 21" are filled with a plastic connecting part 22". The plastic coating 9" or its two-sided plastic coating parts 19" and 20" fill the space between the web 7" and the shanks 8*a*" to 8*d*" in such a manner that the plastic coating 9" and the free ends of the control teeth 5" do not protrude above the level of the lateral edge surfaces 23" of the shanks 8*a*" to 8*d*". In other words, the web and the shanks form a laterally open trough in which the plastic coating forming key elements, is recessed.

In the forward one third portion of the key shaft 3", the middle web 13" made of synthetic plastic comprises a groove shaped depression 24". This depression 24 extends perpendicularly to the lengthwise direction of the key shaft 3" and thus parallel to the flanks of the control teeth 5". The groove shaped depression 24" serves to fix the key shaft on a catch element 30" of the cylinder lock, FIGS. 13 and 14.

Figure 12:
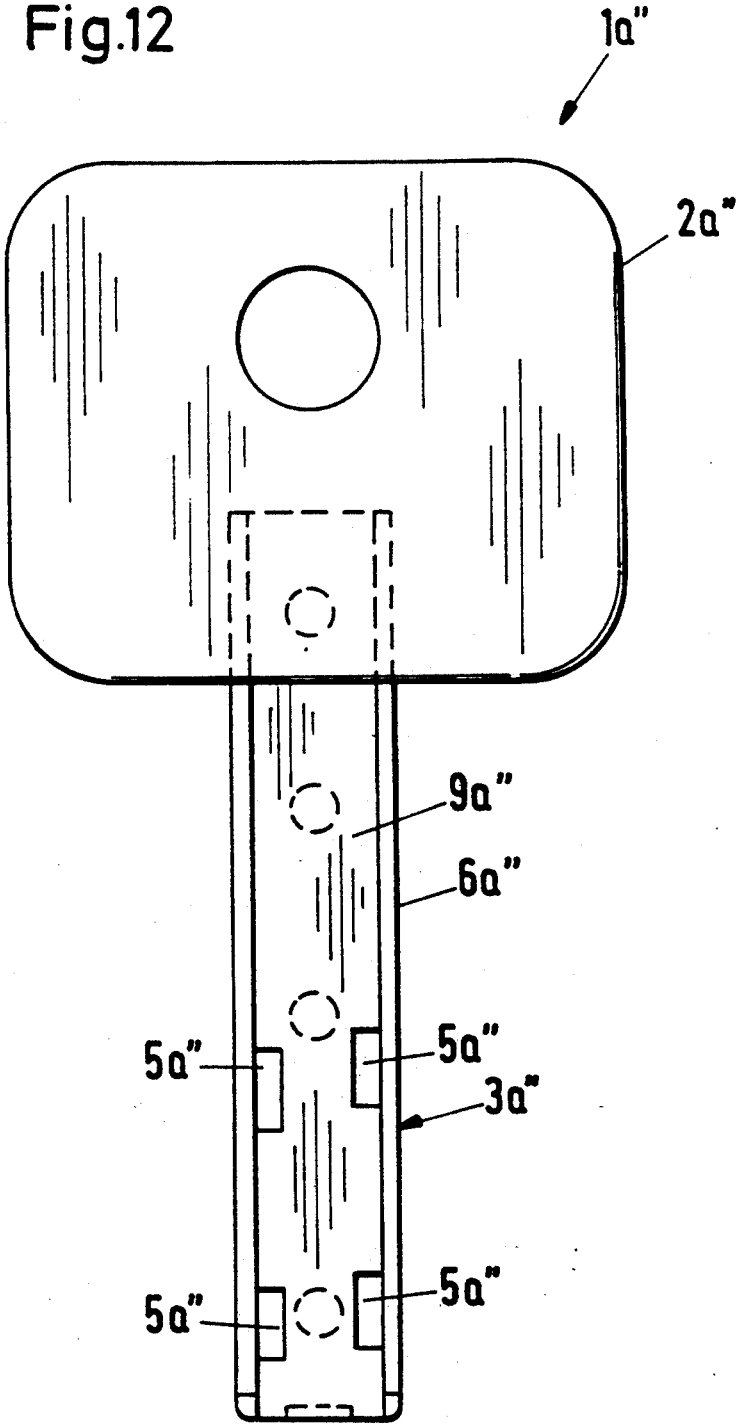
FIG. 12 shows a view as in FIG. 6 of a modified embodiment.

In the example embodiment shown in FIG. 12, a slightly modified key 1*a*" is involved, whereby corresponding parts have the same reference numbers, however, with a letter index.

The key 1*a*" similarly comprises a key grip 2*a*" and a key shaft 3*a*" which, however, does not comprise control teeth, but rather comprises recesses 5*a*" and/or through-holes 5*a*" in the key shaft 3*a*" as the control element. These recesses and/or through-holes 5*a*" can be arranged in a carrier 6*a*" having a double T-shaped cross-section made of metal only and/or of plastic or a plastic coating 9*a*".

Primarily, the key 1" with control teeth 5" is used in conjunction with a cylinder lock which comprises tumblers tiltably supported about an axis. The control teeth thereby engage recesses in the tumblers. The other key 1*a* with recesses 5*a*" and/or through-holes 5*a*" is similarly used in conjunction with a cylinder lock comprising tiltably supported tumblers whereby, however, the tumblers do not comprise recesses as the control elements, but instead are provided for this purpose with teeth or the like. Beyond that, the manner of operation and functioning of the two cylinder locks is the same.

An essential advantage of the key 1" or 1*a*" exists in that the control elements 5" or 5*a*" on the key shaft 3" or 3*a*" may be formed by spraying a synthetic plastic onto a metallic profile core. The production of the control teeth 5" is thus achieved while no longer requiring a mechanical machining such as milling, but instead by means of exactly targeted spraying deposition on a rail-shaped metal profile which purposely comprises through-holes for anchoring the control teeth. In this context, the production of the keys may be automated to a high degree and may be electronically controlled.

Figure 13:
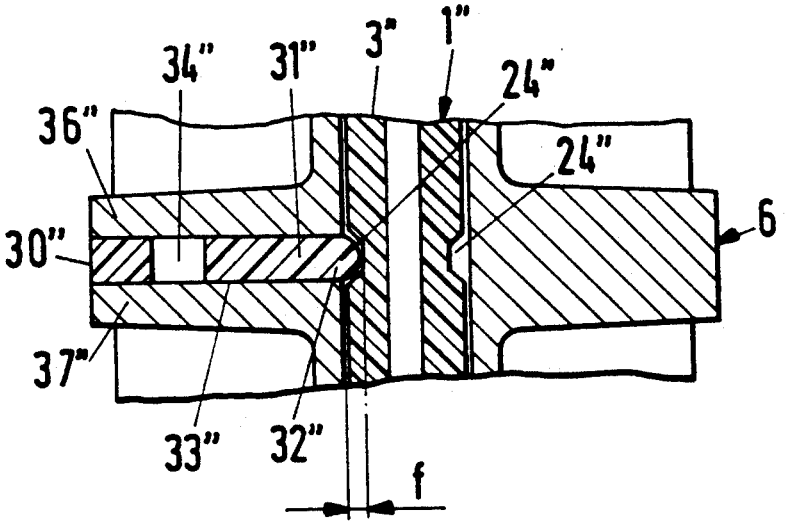
FIG. 13 shows a detail of the cylinder core with a key in a lengthwise section on an enlarged scale.
Figure 14:
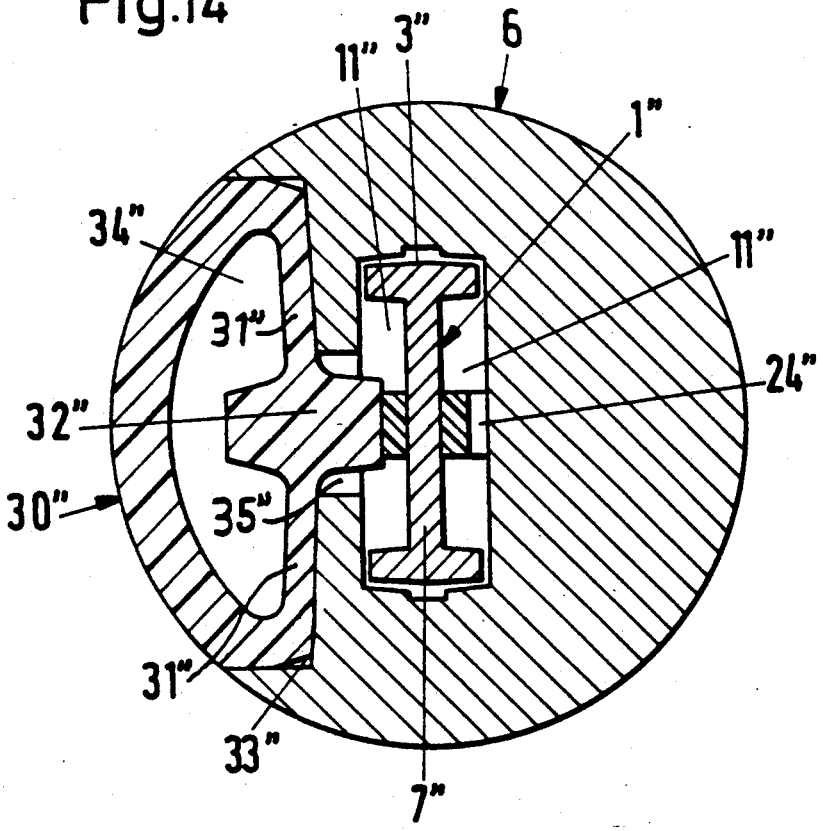
FIG. 14 shows the detail as in FIG. 13, however, in a cross-section.

In order that the tumblers 7*a* to 7*d* or 7*b* do not push the key 3" or 1" out of the key channel, due to the torque springs 16 acting on the tumblers, a catch element 30" in the form of a spring element is provided in the embodiment of FIGS. 13 and 14. According to this example embodiment the catch element 30" comprises a spring web 31" free to flex and carrying a catch nose 32" protruding beyond the spring web 31" toward the key. The catch nose 32" is in a position to bridge a spring path f according to FIG. 13, in order to elastically retreat from the catch position shown in FIG. 13 into a release position when the key 1" is pulled out. The catch element 30" preferably lies continuously with its circumference in a recess 33" of the cylinder core 6 and comprises a recess 34" behind the spring web 32" for providing a spring characteristic for said elastical retreat. The recess 33" in the cylinder core 6 extends with a through-hole 35" for the catch nose 32" all the way into the key channel and is limited by two wall elements 36" and 37" according to FIG. 13 for supporting and holding the catch element 30".

FIG. 14 shows that the catch element 30" is a spring element of plastic material in the form of a hollow segment having a chord portion forming said spring web 31" which carries the catch nose 32". The hollow segment also has an arc portion fitting into the cylinder core 6 as best seen in FIG. 14.

Although the invention has been described with reference to specific example embodiments it will be appreciated that it is intended to cover all modifications and equivalents within the scope of the appended claims.

We claim:

1. A lock and key combination, comprising a locking cylinder and a key, said locking cylinder comprising a cylinder housing, at least one blocking channel, and a cylinder core in said cylinder housing, a key channel in said cylinder core, a plurality of tumblers mounted in said cylinder core, a tumbler axis provided for each of said tumblers so that each tumbler is tiltable about its own tumbler axis, at least one protruding cam or a recess on said key or on said tumblers for transforming a linear key motion in said key channel into a rotation of said tumblers about their axes, said key comprising a depression, said cylinder core comprising a recess including a through-hole opening toward said depression, a catch element mounted in said recess, said catch element comprising a spring web and a catch nose in said spring web, said catch nose projecting through said through-hole for cooperation with said depression in said key, whereby said spring web normally urges said catch nose into said depression, said key further comprising a metal key shaft having cut-outs and plastic key control elements recessed in said cut-outs for protecting said plastic key control elements.

2. The lock and key combination of claim 1, wherein each of said tumblers comprises on its circumference at least one nose tiltable into said blocking channel.

3. The lock and key combination of claim 1, wherein each of said tumblers comprises two ratchet teeth on its circumference for forming a recess between said ratchet teeth.

4. The lock and key combination of claim 3, wherein each of said tumblers comprises on its circumference at least one nose and wherein said ratchet teeth are arranged diametrically opposite of said nose.

5. The lock and key combination of claim 1, further comprising torsion spring means arranged for cooperation with said tumblers for urging said tumblers into a locking position.

6. The lock and key combination of claim 1, wherein said cylinder core comprises radially outwardly open pockets, said tumblers being mounted in said open pockets.

7. The lock and key combination of claim 1, wherein said key comprises control teeth positioned on said key in more than one key plane, and wherein said tumblers comprise recesses and ratchet teeth arranged on a circumference of said tumblers for cooperation with said key.

8. The lock and key combination of claim 1, wherein said tumblers comprises recesses and ratchet teeth in more than one plane of said tumblers for cooperation with said key.

9. The lock and key combination of claim 1, further comprising an insert inserted into said cylinder core, said insert carrying at least one of said tumbler axes.

10. The lock and key combination of claim 1, wherein said insert has at least partly the same contour as said cylinder core.

11. The lock and key combination of claim 1, wherein at least two tumblers are arranged in a radial plane of said cylinder core.

12. The lock and key combination of claim 1, wherein said metal key shaft of said key comprises an I-cross-section with two chords interconnected by a web, whereby said cut-outs are formed as laterally open troughs surrounded by metal of said key shaft, said plastic key elements being recessed in said troughs.

13. The lock and key combination of claim 1, wherein said catch element mounted in said recess of said cylinder core, comprises a hollow segment of plastic material having a chord portion forming said spring web carrying said catch nose, and an arc portion fitting into said cylinder core.

14. The key of claim 12, comprising a synthetic plastic coating at least partially covering said metal key shaft, said synthetic plastic coating forming said control elements.

15. The key of claim 12, wherein said control elements are protruberances in the form of control teeth which stand perpendicularly to a flat surface of said metal key shaft.

16. The key of claim 15, wherein said control teeth are recessed into said flat surface of said metal key shaft.

17. The key of claim 12, wherein said web comprises at least one through-hole, and wherein synthetic plastic material forming said control elements is anchored into said through-hole or through-holes.

18. The key of claim 17, wherein said at least one through-hole is an elongated hole.

19. The key of claim 12, wherein said control elements are arranged directly next to said chords of said I-cross-section of said metal key shaft.

20. The key of claim 12, wherein said web comprises flat surfaces, said control elements comprising control teeth on each of said flat surfaces of said web.

21. The key of claim 12, further comprising a plastic coating on both sides of said web of said metal key shaft, said plastic coating comprising a middle portion, lateral recesses in said middle portion, said control elements forming teeth extending from said middle portion to said chords of said metal key shaft, and plastic interconnecting parts reaching through through-holes in said web of said I-cross-section of said key shaft.

22. The key of claim 21, wherein said middle portion of said plastic coating comprises a groove-shaped depression.

23. The key of claim 12, wherein said control elements comprise recesses and/or through-holes arranged in said web of said metal key shaft.

* * * * *

UNITED STATES PATENT AND TRADEMARK OFFICE

CERTIFICATE OF CORRECTION

PATENT NO. : 5,189,895

DATED : March 2, 1993

INVENTOR(S) : Dittmar Schwab et al.

It is certified that error appears in the above-indentified patent and that said Letters Patent is hereby corrected as shown below:

On the title page, item [73], please replace the name of the Assignee to read --YMOS Aktiengesellschaft Industrieprodukte--;

Column 7, line 14, claim 10, replace "1" by --9--.

Signed and Sealed this

Fourth Day of January, 1994

*Attest:*

Bruce Lehman

BRUCE LEHMAN

*Attesting Officer*

*Commissioner of Patents and Trademarks*